US009951582B2

(12) United States Patent
Baudoin

(10) Patent No.: US 9,951,582 B2
(45) Date of Patent: Apr. 24, 2018

(54) PRESSURE ACTIVATED CYCLICAL VALVE APPARATUS AND METHOD

(71) Applicant: KLX ENERGY SERVICES LLC, Houston, TX (US)

(72) Inventor: Toby Scott Baudoin, Rayne, LA (US)

(73) Assignee: KLX Energy Services LLC, Houston, TX (US)

( * ) Notice: Subject to any disclaimer, the term of this patent is extended or adjusted under 35 U.S.C. 154(b) by 313 days.

(21) Appl. No.: 14/801,343

(22) Filed: Jul. 16, 2015

(65) Prior Publication Data

US 2016/0017690 A1 Jan. 21, 2016

Related U.S. Application Data

(60) Provisional application No. 62/027,058, filed on Jul. 21, 2014.

(51) Int. Cl.

| | |
|---|---|
| ***E21B 34/14*** | (2006.01) |
| ***E21B 23/00*** | (2006.01) |
| *E21B 34/00* | (2006.01) |

(52) U.S. Cl.
CPC ..... *E21B 34/14* (2013.01); *E21B 23/006* (2013.01); *E21B 2034/007* (2013.01)

(58) Field of Classification Search
CPC ..... E21B 34/14
See application file for complete search history.

(56) References Cited

U.S. PATENT DOCUMENTS

2005/0230119 A1* 10/2005 McGarian ..... E21B 23/006 166/334.4
2006/0243455 A1* 11/2006 Telfer ..... E21B 21/103 166/386

* cited by examiner

*Primary Examiner* — Robert E Fuller
(74) *Attorney, Agent, or Firm* — Drinker Biddle & Reath LLP

(57) ABSTRACT

A bypass tool has a piston movable within the bore of a central housing. A control slot on an exterior wall of the piston engages a slot pin in the housing. Longitudinal movement of the piston is downward, in response to fluid pressure exerted on a ball seated on a ball seat on the piston; and spring biased upward. The control slot and slot pin rotate the piston as it moves longitudinally between a first, upper position in which bypass ports in the housing are closed, and a second, lower position in which the bypass ports are open. An intermediate longitudinal position has the ports closed, and permits pressuring up on a ball to force it through the ball seat and reset the tool in the flow through position. The ball and/or ball seat may be of resilient material to permit passage of the ball through the seat.

7 Claims, 6 Drawing Sheets

PRESSURE ACTIVATED CYCLICAL VALVE APPARATUS AND METHOD

CROSS REFERENCE TO RELATED APPLICATIONS

This non-provisional United States Patent Application claims priority to U.S. Provisional patent application SN 62/027,058, filed Jul. 21, 2015, for all purposes. The disclosure of that provisional patent application is incorporated herein by reference, to the extent not inconsistent with this disclosure.

FIELD OF THE INVENTION

This invention pertains to downhole equipment for oil and gas wells. More particularly, it pertains to a pressure activated cyclical valve apparatus for use on a wellbore pipe string such as a coiled tubing string or pipe string and, more particularly, this invention relates to an apparatus for bypassing flow around a downhole tool string.

BACKGROUND OF THE INVENTION

During the drilling, work over, or plug and abandonment of oil and gas producing wellbores, a variety of down hole tools may be attached to a pipe or coiled tubing string and utilized to perform various functions within the wellbore. Circumstances arise making it desirable to bypass flow around the downhole tool string within the wellbore. These circumstances can include lost circulation, well control, the need for an increased pump rate, and others of the like which require the flow of fluid within the pipe string to be bypassed around the tool string.

Current cyclical bypass valve devices employ a deformable ball to activate the bypass valve, allowing fluid to travel around the tool string and within the wellbore. A second, metal ball(s) is employed to close the bypass valve off and allow circulation to continue through the tool string. Pumping a ball through a pipe or coiled tubing string is a very time consuming process, especially through a coiled tubing string where the ball must travel through the entire spool of coiled tubing before it even reaches the vertical column within the wellbore.

Consequently, there is a need for a pressure activated cyclical valve apparatus which employs only a single ball to both activate and deactivate the bypass valve configured within the apparatus.

SUMMARY OF THE INVENTION

The present invention is for a new pressure activated cyclical valve apparatus to satisfy the aforementioned needs. The pressure activated cyclical valve apparatus, hereafter referred to as "PACV apparatus" or simply "apparatus", is comprised of a top sub, a bottom sub, a housing, a piston, an expanding ball seat, a major sleeve, a minor sleeve, a primary spring, a secondary spring, and a seal insert. The housing is threadedly attached to the top sub, with the bottom sub threadedly attached to the housing. The piston is free to slide within the housing, with the minor sleeve located within the upper bore of the piston, and the expanding ball seat contained within said sleeve; the expanding ball seat is illustrated here as being made of plastic, but the apparatus could also be embodied using a metal seat and a deforming plastic ball. The major sleeve is slidably engaged with the central bore of the piston. The seal insert is placed inside the top sub and contains seals that function to close off the uphole section of the apparatus from the bypass port(s).

During normal drilling or workover operations, fluid, which can be a liquid, gas, or a combination thereof, is circulated through a downhole tool string. In the event that operators need to bypass the tool string downhole of the apparatus, an activating ball is pumped through the coiled tubing or pipe string and contacts the expanding ball seat, creating a constriction in the flow of fluid. The operator can then increase the flow rate from the pump and build pressure to move the minor sleeve down against the force of the secondary spring, so that the minor sleeve seats against a corresponding shoulder inside the piston, creating a substantial fluid seal. Fluid pressure then shifts the piston downwards, opening the bypass port(s) in the housing. Fluid is then free to flow into the wellbore, such as for the deposition of lost circulation material (LCM), increasing the flow rate beyond the flow ratings of downhole tools, the use of heavy drilling mud to "kill" a well, etc.

When ready to close the bypass port(s), the operator need only stop circulating fluid downhole. Once the fluid inside the apparatus has drained out through the bypass port(s) and the pressure has equalized within the central bore, the secondary spring will shift the minor sleeve back upward, breaking the fluid seal and allowing the primary spring to bias the piston upwards to its original position without pressurizing the column of fluid above it. As the piston shifts upward, it will also rotate, as dictated by the position control slot on the outer surface of said piston.

Once the piston has traveled upwards to its original position, circulation is continued, and fluid pressure is again applied to the ball and ball seat, shifting the minor sleeve back down and again creating a fluid seal, while still blocking the bypass port(s). Pressure builds up against the piston, which is now constrained from moving downwards by the aforementioned position control slot. Upon reaching a known pressure, the ball seat will deform slightly, allowing the ball to extrude through, and then return to its original shape. Once the ball passes through the seat, it is contained by the major sleeve, which is perforated to allow fluid to circulate around the trapped ball(s) and further through the apparatus.

After the ball is clear of the seat, fluid flow is restored to the central bore of the apparatus, and the minor sleeve will shift, along with the piston, urged upward by the primary and secondary springs. The piston will again rotate, following the position control slot, and is now in its initial position, and the apparatus is ready to be used again.

DESCRIPTION OF THE EMBODIMENTS

Figure 1:
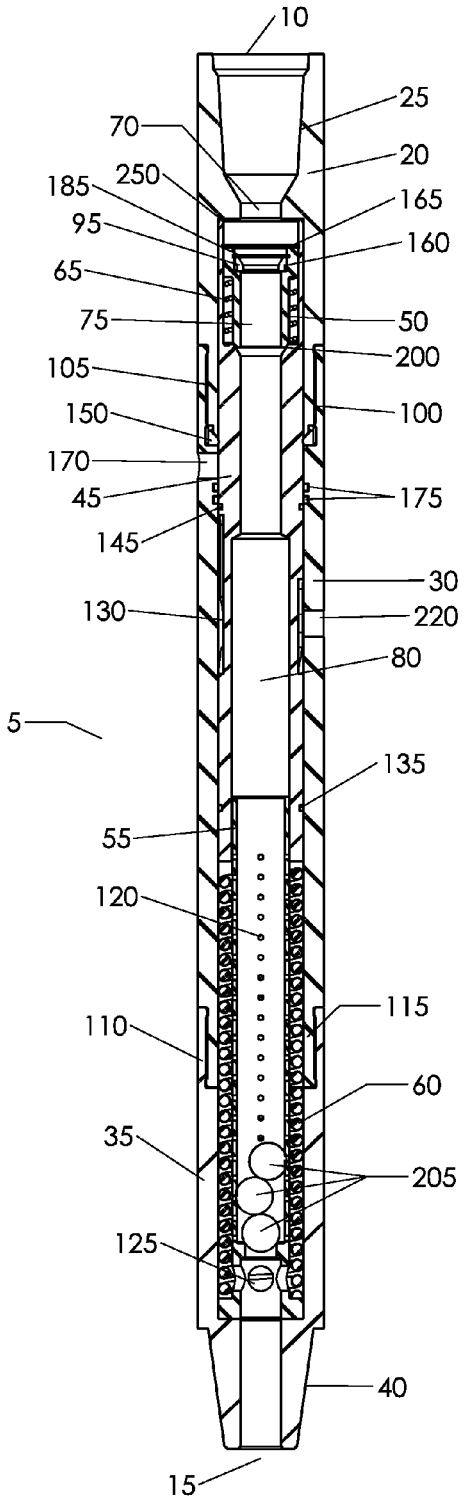
FIG. 1 is a longitudinal cross-sectional view of the PACV apparatus.

FIG. 1 shows an embodiment of the PACV apparatus (5) of the present invention utilized to provide a means of bypassing fluid around the tool string and into the wellbore, should such a need arise. The apparatus (5) is configured for threadable attachment to a pipe or coil tubing string deployed in a wellbore having a central bore through which fluid may be introduced. The apparatus (5) is positioned on the pipe string so that it extends longitudinally along the axis of the pipe string to which it is threadedly attached.

Figure 2:
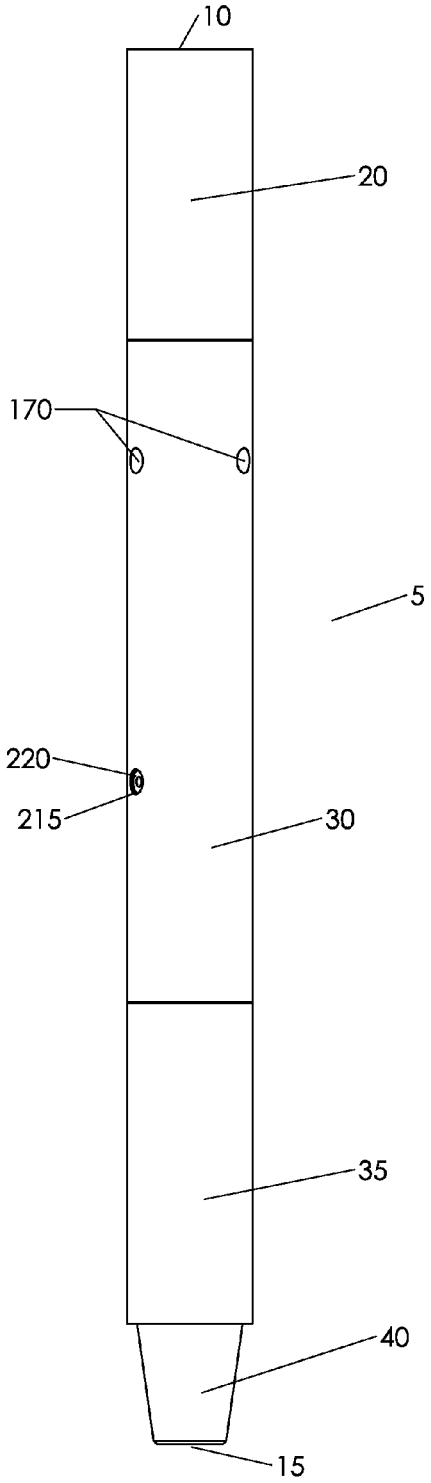
FIG. 2 is a longitudinal view of the PACV apparatus.

In the configurations shown in FIGS. 1 and 2, the apparatus (5) is comprised of a top sub (20), a housing (30), a piston (45), a minor sleeve (50), and expanding ball seat (95) (made of a deformable plastic, embodied here with virgin polyetheretherketone, or PEEK), a major sleeve (55), a primary spring (60), a secondary spring (65), and a bottom sub (35). The upper end of the apparatus (5) is referenced by (10) and the lower end by (15). Apparatus (5) is configured for threadable attachment to a pipe string by means of an upper threaded connection (25) of top sub (20). A lower threaded connection (40) is configured on bottom sub (35) for threadable attachment to a BHA (bottom hole assembly). The top sub (20), housing (30), minor sleeve (50), major sleeve (55), piston (45), and the bottom sub (35) all contain a central bore which are in communication with the central bore of the pipe string. The top sub (20) and housing (30) are threadedly connected via threaded connection (100) of central housing (30) and threaded connection (105) of top sub (20). The housing (30) and bottom sub (35) are threadedly connected via connection (110) of bottom sub (35) and connection (115) of central housing (30). Piston (45) is aligned axially with the tool string and is concentric to central bore (70) of top sub (20), and is allowed to slide freely, as constrained by the interaction of a position control slot (130) on piston (45) and slot pin (220), statically engaged with housing (30). Seals (145) and (135) prevent fluid and contaminants from entering the position control slot (130), which would disrupt the action of position control slot pin (220) traveling within position control slot (130). The minor sleeve rests within the upper bore of piston (45) and is constrained by retaining ring (165), which can be replaced by set screws, a threadedly attached shoulder, etc. The expanding ball seat (95) is concentric with minor sleeve (50) and is statically engaged within it. The expanding ball seat (95) is shown here held in place by retaining ring (185), but could be held by set screws, attachment threads, etc. The major sleeve (55) is concentric with the bore of bottom sub (35) and rests inside bore (80) of piston (45), surrounded by primary spring (60), which holds major sleeve (55) against bottom sub (35) and holds piston (45) against shoulder (250) of top sub (20) when apparatus (5) is not in use. Major sleeve (55) serves as a container for spent ball(s) (205) that were used in prior activations of apparatus (5), and has radial perforations (120) to allow continued fluid flow around primary spring (60) and out of the apparatus (5) by way of exit port(s) (125). The perforations in the major sleeve can be a number of holes, longitudinal slots, or the like, so long as they do not cause substantial reduction in the flow rate through the apparatus. The minor sleeve (50) is concentrically located within piston (45), surrounded by secondary spring (65).

Figure 5:
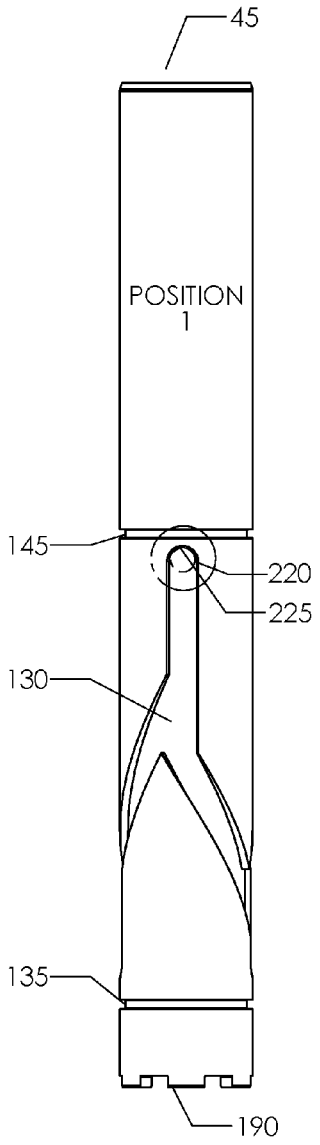
FIG. 5 is a longitudinal view of the piston, showing the position control slot.

FIG. 1, a longitudinal cross-sectional view of the pressure activated cyclical valve apparatus (5), illustrates the position of the components of apparatus (5) in the fully closed, deactivated configuration, as also illustrated in FIG. 5. Seals (150) and (175) prevent the flow of fluid through bypass port(s) (170) (better seen in FIG. 3) and force the fluid through central bore (80) of piston (45). Piston (45) is in its first, upper position, in which bypass ports (170) are closed and fluid flow is through the tool.

Figure 3:
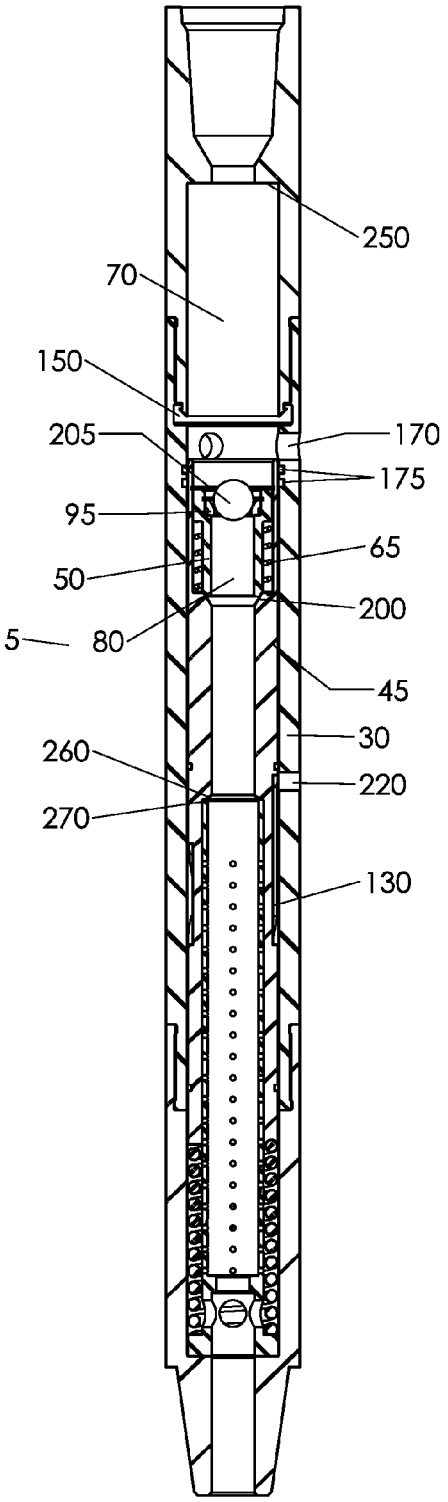
FIG. 3 is a longitudinal detail view of the cross section of the PACV apparatus shown in FIG. 1, showing the piston in the fully activated position.
Figure 6:
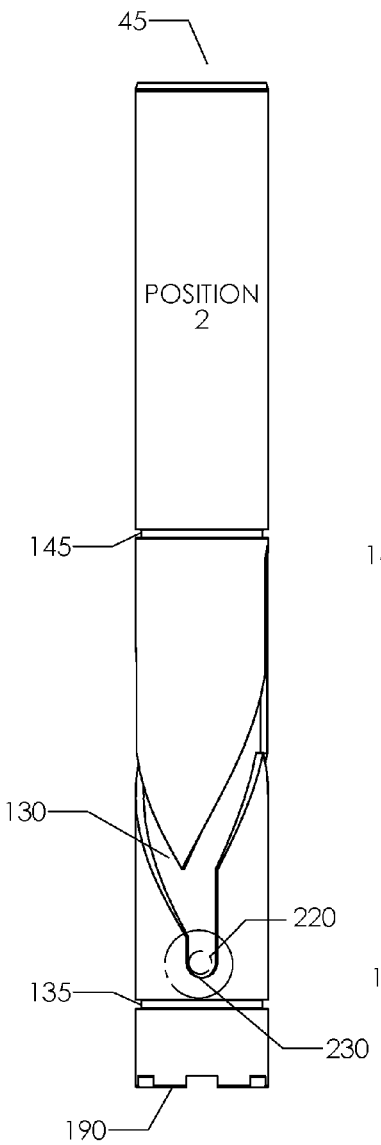
FIG. 6 is a longitudinal view of the piston shown in FIG. 5, rotated 90°.

FIG. 3 shows the apparatus (5) in the fully opened, activated position, as also illustrated in FIG. 6. Piston (45) is in its second, lower position, in which bypass ports (170) are open. A circulation ball (205) is pumped from surface through the pipe or coiled tubing string until it lands against expanding ball seat (95), which blocks the flow of fluid through apparatus (5). Continued pumping creates fluid pressure which then overcomes the upwards force of secondary spring (65) and forces minor sleeve (50) downwards until it comes into contact with shoulder (200) of piston (45), thus creating a face seal between the two components. The additional buildup of pressure then overcomes the upward force of primary spring (60), which then forces piston (45) downwards to its second, lower position, as it also rotates 90° in relation to the piston control slot pin (220) acting within piston control slot (130). Piston (45) will continue to travel downwards until shoulder (260) comes into contact with shoulder (270) of major sleeve (55). At this moment, piston (45) has reached its lowermost position, thus opening bypass port(s) (170) and allowing fluid being circulated from surface to freely travel through bypass port(s) (170) and into the wellbore. It is to be understood that by interaction of control slot (130) and slot pin (220), piston (45) moves rotationally as it moves longitudinally.

When there is no longer a need to bypass fluid through bypass port(s) (170) of apparatus (5), the pump on surface is turned off and circulation is stopped. Once pressure has equalized within apparatus (5), secondary spring (60) will overcome the downward fluid pressure and bias minor sleeve (50) upwards until it rests against snap ring (165), thus breaking the face seal against shoulder (200) of piston (45). Fluid may then travel around circulation ball (205) and minor sleeve (50) and back into bore (80) of piston (45). Primary spring (60) can then overcome the downward fluid pressure and bias piston (45) upwards as piston (45) also rotates an additional 90° in relation to the piston control slot pin (220) acting within the piston control slot (130). Bypass port(s) (170) are subsequently closed off by piston (45) moving across seals (175) and (150). Piston (45) will continue to travel upwards until it comes into contact with shoulder (250) of top sub (20). The piston is then in its uppermost position, as seen in FIG. 1, but rotated 180°.

Figure 4:
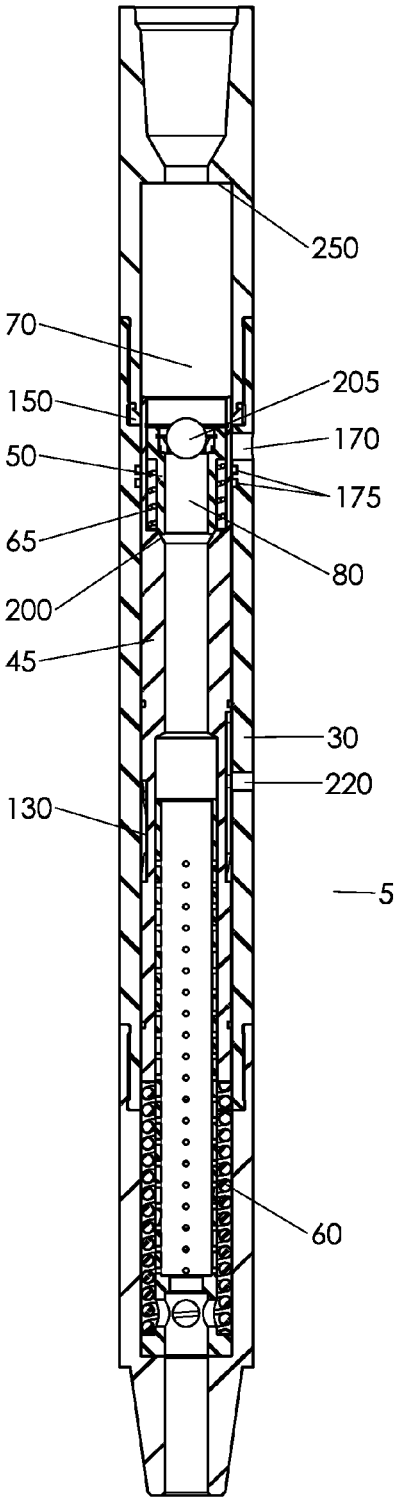
FIG. 4 is a longitudinal detail view of the cross section of the PACV apparatus shown in FIG. 1, showing the piston in the deactivated position.
Figure 7:
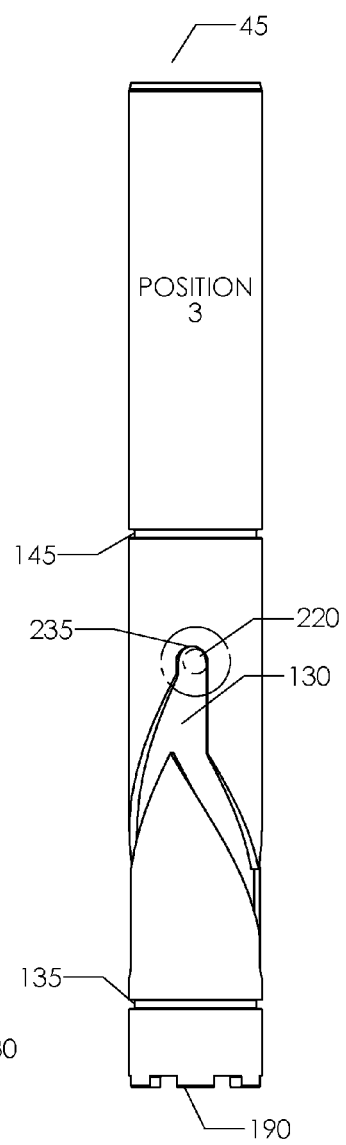
FIG. 7 is a longitudinal view of the piston shown in FIGS. 5 and 6, rotated a further 90°.

FIG. 4 shows the apparatus (5) in its lower closed (intermediate) position, as also illustrated in FIG. 7. Once piston (45) has reached its initial position, the pump is turned back on and circulation is continued. Fluid pressure overcomes the upward force of secondary spring (65), thus forcing minor sleeve (50) downwards until it comes into contact with shoulder (200) of piston (45), thus creating a face seal. Fluid pressure then overcomes the upward force of primary spring (60), forcing piston (45) downwards as it rotates 90° in relation to the piston control slot pin (220) acting within piston control slot (130). Piston (45) continues to travel downwards until piston control slot pin (220) comes into contact with a lower shoulder (235) of position control slot (130), as seen in FIG. 7. In this intermediate longitudinal position, bypass port(s) (170) are still closed off to the inner bore of apparatus (5). Pressure build up will then cause expandable ball seat (95) to slightly deform, allowing circulation ball (205) to be extruded into the central bore of major sleeve (55). Fluid pressure is then relieved through apparatus (5), and circulation can then continue through the central bore of apparatus (5). Secondary spring (65) then overcomes the downward fluid pressure, and biases minor sleeve (50) back upwards until it rests against snap ring (185). Primary spring (60) then forces piston (45) upwards, as it rotates another 90° in relation to the piston control slot pin (220) acting within the piston control slot (130). Piston (45) has now returned to its initial position, as shown in FIG. 1, and apparatus (5) is ready for reactivation. It is to be understood that either or both of ball (205) and ball seat (95) may be of resilient material, to permit passage of ball (205) through ball seat (95) when sufficient pressure is applied to ball (205).

It is understood that the apparatus comprises a means for generating relative rotational movement between piston 45 and housing 30 by way of relative longitudinal movement between piston 45 and housing 30, in order to place piston 45 in its various positions, as described above and described in more detail below, in connection with FIGS. 5-7. In the above description, the means for generating relative rotational movement between piston 45 and housing 30 by way of relative longitudinal movement between piston 45 and housing 30 comprises piston control slot 130 on the outer surface of piston 45, interacting with slot pin 220 mounted on housing 30 and protruding into piston control slot 130, as can be seen in the figures. In another embodiment, the respective positions of the slot and pin are effectively reversed; an appropriately shaped control slot is formed within the inner wall of housing 30, and a pin protrudes from piston 45 into the control slot. As can be understood by one having skill in the relevant art, relative longitudinal movement between piston 45 and housing 30 will result in the desired relative rotation between piston 45 and housing 30 will be generated by this embodiment, as well.

FIG. 5 shows a detail view of the position control slot (130) on the outer surface of piston (45). Said position control slot (130) is lubricated to facilitate easy motion, and seals (145) and (135) prevent fluid from contaminating or removing this lubrication. In activating apparatus (5), fluid pressure is applied against expanding ball seat (95), and piston (45) shifts down and rotates 90° into its second position, so that position control slot pin (220) makes contact with shoulder (225) at the same time that piston (45) makes contact with major sleeve (55), keeping piston (45) from sliding down any further, and leaving bypass ports (170) fully opened.

FIG. 6 shows piston (45) in position 2, which is 90° relative to FIG. 5. When the need for apparatus (5) has passed, pressure is decreased, allowing primary spring (65) to force piston (45) back upward, while piston (45) rotates 90° into its third position, with position control slot pin (220) in contact with shoulder (230) of position control slot (130) and piston (45) in contact with top sub (30).

FIG. 7 shows a further rotated view of the piston (45) shown in FIGS. 5 and 6, noted as position 3. In order to clear expanding ball seat (95) of its obstructing ball (205), fluid pressure is applied again, and piston (45) shifts down slightly to its intermediate longitudinal position, but cannot open bypass port(s) (170). This will build up pressure and extrude circulation ball (205) through expanding ball seat (95), restoring flow through the apparatus (5). Once the operation is complete and ball (205) has passed into central bore (75) of minor sleeve (50), piston (45) shifts back to position 1, as shown in FIGS. 1 and 5, and apparatus (5) is again ready for use.

Figure 8:
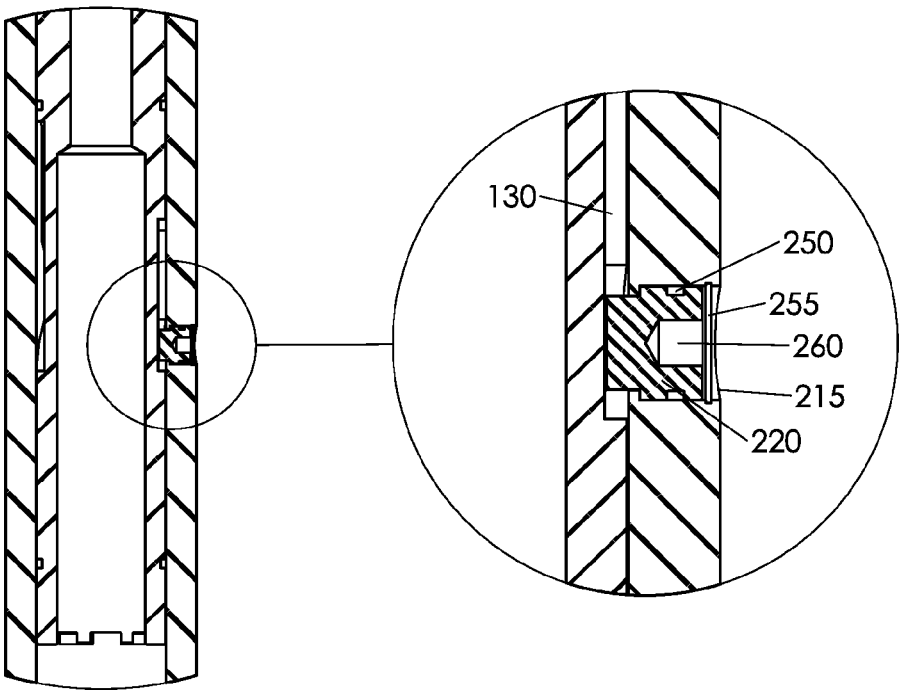
FIG. 8 is a detail view of the position control slot pin engaged with the housing, and its interaction with the position control slot.

FIG. 8 shows a detail view of the position control slot pin (220) engaged with central housing (30) via pin hole (215). Fluid is prevented from escaping the position control slot (130) by means of O-ring seal (250). The position control slot pin (220) is statically held within pin hole (215) by snap ring (255), and is internally threaded in bolt hole (260), so that a bolt can be threaded into the position control slot pin (220) and said position control slot pin (220) can be inserted or removed from pin hole (215). Means for containing position control slot pin (220) within pin hole (215) can be a snap ring (225) as shown in FIG. 8, attachment threads, adhesives, set screw, cam configurations, or anything of the like that provides means for holding position control slot pin (220) statically engaged within pin hole (215).

Figure 9:
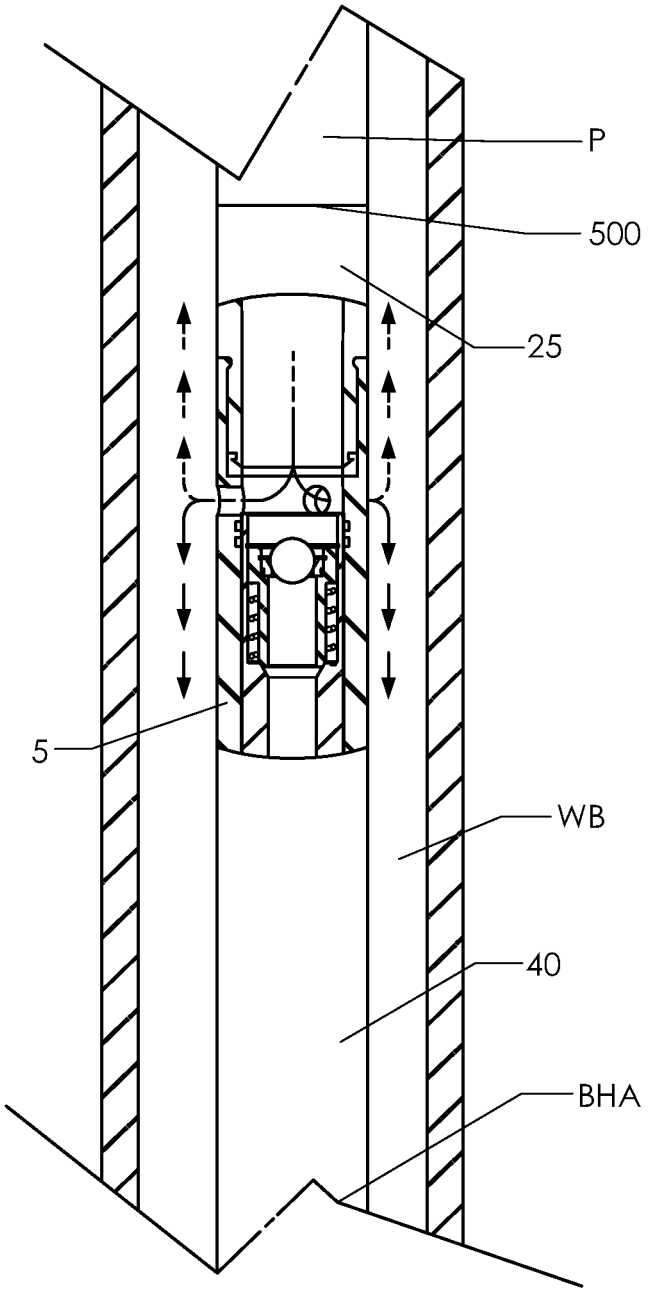
FIG. 9 is a view of the PACV in a wellbore attached to other downhole tools in the activated or bypassing position.

In FIG. 9, the PACV apparatus (5) is positioned and threadedly attached to the down hole end (500) of a pipe or coiled tubing string (P) by means of upper threaded connection (25) at the top end (10) of the apparatus (5). A tool string, often referred to as a bottom hole assembly (BHA) is then attached to the PACV apparatus (5) by means of threaded connection (40) at the bottom end (15) of bottom sub (35). The sequence of connections of the pipe or coiled tubing string (P) and the bottom hole assembly (BHA) to PACV apparatus (5) may be reversed as desired. After such assembly the pipe or coiled tubing string (P) with the attached PACV apparatus (5) and BHA may be inserted into wellbore (WB) for use. In the configuration shown in FIG. 9, fluid is bypassed around the bottom hole assembly (BHA) and back into the wellbore (WB), as shown by the arrows in the sectioned view.

Figure 10:
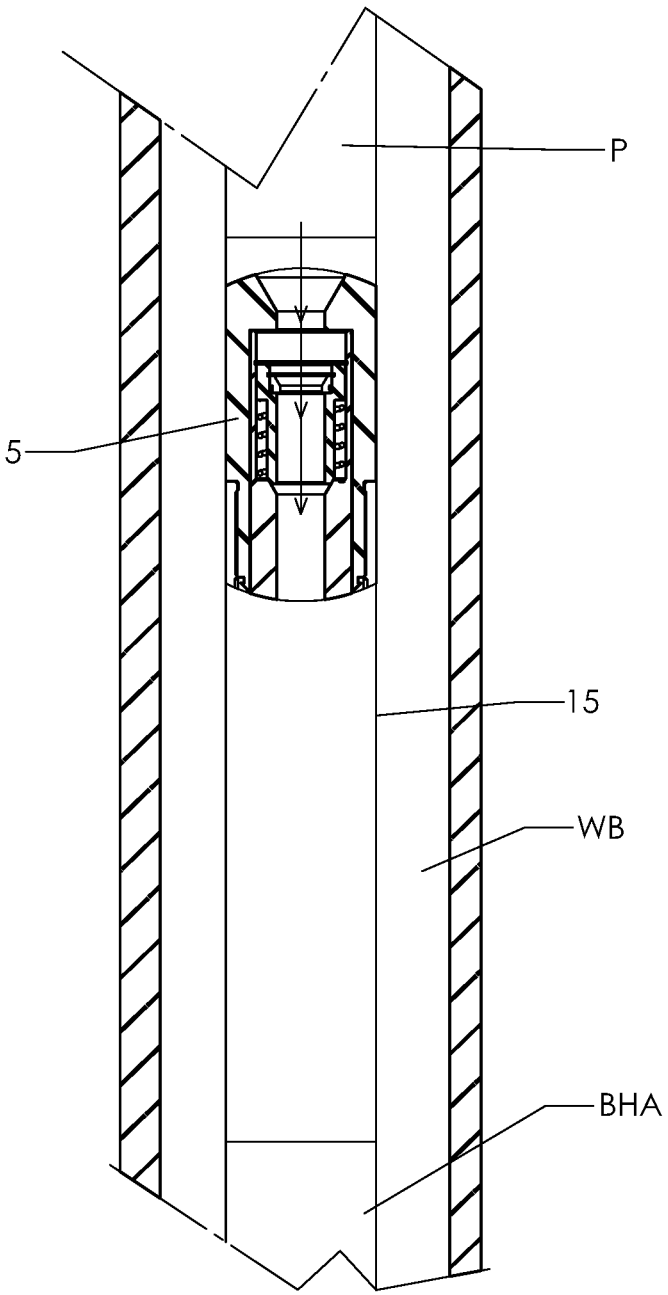
FIG. 10 is a view of the PACV in a wellbore attached to other downhole tools in the deactivated or running position.

FIG. 10 shows the PACV apparatus (5) inserted into the wellbore (WB) in the same sequence as illustrated in FIG. 9, with apparatus (5) in the deactivated position. As shown by the arrows in the sectioned view, fluid is allowed to flow through the central bore of apparatus (5) during normal operations.

CONCLUSION

It is understood that various changes may be made to the design of the present invention without departing from the scope and spirit thereof. For example, either or both of ball (205) and ball seat (95) may be of resilient material, to permit passage of the ball through the seat; major sleeve (55) may have fluid passages at its lowermost end, in lieu of or in addition to perforations (120); ball seat (95) may be positioned within piston (45), with minor sleeve (50) omitted; and in certain embodiments, major sleeve (55) may be omitted, as long as some accommodation for balls (205) is made.

Therefore, the scope of the invention is not limited to the described embodiment(s), but by the scope of the appended claims and their legal equivalents.

I claim:

1. A pressure activated cyclical bypass apparatus, comprising:

a cylindrical central housing having a longitudinal bore therethrough, said central housing comprising top and bottom subs comprising threaded connections for attachment to a pipe string for placement downhole in a wellbore, said central housing comprising one or more bypass ports therein which permit fluid flow from said bore through a wall of said central housing;

a cylindrical piston comprising a longitudinal bore therethrough, said piston slidingly disposed in said bore of said central housing, movable between a first, upper longitudinal position wherein said piston blocks flow through said bypass ports, and a second, lower longitudinal position wherein said bypass ports are open, said piston comprising a ball seat to sealingly accommodate a ball seated thereon, at least one of said ball seat and said ball comprising a resilient material permitting passage of said ball through said ball seat when sufficient pressure is applied to said ball;

a piston spring disposed in said central housing, biasing said piston toward said first, upper position; and a minor sleeve having a longitudinal bore therethrough, disposed in said piston and spring biased toward a first upper position, and wherein said ball seat is disposed in said minor sleeve, said minor sleeve movable between said first upper position and a second lower position wherein said minor sleeve seals on a shoulder within said bore of said piston, wherein said piston comprises a control slot in an exterior surface thereof, engaging a slot pin disposed within said central housing, wherein said control slot comprises a shape which under engagement with said slot pin rotates said piston as said piston moves longitudinally, and wherein said shape in a first rotational position permits said piston to move to said second longitudinal position, thereby opening said bypass ports, and said shape in a second rotational position permits said piston to move to a longitudinal position intermediate said first longitudinal position and said second longitudinal position wherein said bypass ports are not open, said piston movable between said first and second rotational positions by sequential longitudinal movement.

2. A pressure activated cyclical bypass apparatus, comprising:

a cylindrical central housing having a longitudinal bore therethrough, said central housing comprising top and bottom subs comprising threaded connections for attachment to a pipe string for placement downhole in a wellbore, said central housing comprising one or more bypass ports therein which permit fluid flow from said bore through a wall of said central housing;

a cylindrical piston comprising a longitudinal bore therethrough, said piston slidingly disposed in said bore of said central housing, movable between a first, upper longitudinal position wherein said piston blocks flow through said bypass ports, and a second, lower longitudinal position wherein said bypass ports are open, said piston comprising a ball seat to sealingly accommodate a ball seated thereon, at least one of said ball seat and said ball comprising a resilient material permitting passage of said ball through said ball seat when sufficient pressure is applied to said ball;

a piston spring disposed in said central housing, biasing said piston toward said first, upper position; and a cylindrical major sleeve disposed in a lower portion of said central housing within said piston spring, said major sleeve adapted to receive one or more balls when said balls have passed through said ball seat, wherein said piston comprises a control slot in an exterior surface thereof, engaging a slot pin disposed within said central housing, wherein said control slot comprises a shape which under engagement with said slot pin rotates said piston as said piston moves longitudinally, and wherein said shape in a first rotational position permits said piston to move to said second longitudinal position, thereby opening said bypass ports, and said shape in a second rotational position permits said piston to move to a longitudinal position intermediate said first longitudinal position and said second longitudinal position wherein said bypass ports are not open, said piston movable between said first and second rotational positions by sequential longitudinal movement.

3. The apparatus of claim 2, wherein a lower end of said major sleeve comprises fluid passages.

4. The apparatus of claim 2, wherein said major sleeve comprises one or more holes therein.

5. A pressure activated cyclical bypass apparatus, comprising:

a cylindrical central housing having a longitudinal bore therethrough and connections for attachment to a pipe string, for placement downhole in a wellbore, said central housing comprising one or more bypass ports therein which permit fluid flow from said bore through a wall of said central housing;

a cylindrical piston comprising a longitudinal bore therethrough, said piston slidingly disposed in said bore of said central housing, movable between a first, upper longitudinal position wherein said piston blocks flow through said bypass ports, and a second, lower longitudinal position wherein said bypass ports are open, said piston comprising a minor sleeve having a longitudinal bore therethrough, disposed in said piston and spring biased toward a first upper position, said minor sleeve comprising a ball seat to sealingly accommodate a ball seated thereon, at least one of said ball seat and said ball comprising a resilient material permitting passage of said ball through said ball seat when sufficient pressure is applied to said ball, said minor sleeve movable between said first upper position and a second lower position wherein said minor sleeve seals on a shoulder within said bore of said piston;

a piston spring disposed in said central housing, biasing said piston toward said first, upper position;

a cylindrical major sleeve disposed in a lower portion of said central housing within said piston spring, said piston moving therearound, said major sleeve adapted to receive one or more balls when said balls have passed through said ball seat;

wherein said piston comprises a control slot in an exterior surface thereof, engaging a slot pin disposed within said central housing, wherein said control slot comprises a shape which under engagement with said slot pin rotates said piston as said piston moves longitudinally, and wherein said shape in a first rotational position permits said piston to move to said second longitudinal position, thereby opening said bypass ports, and said shape in a second rotational position permits said piston to move to a longitudinal position intermediate said first longitudinal position and said second longitudinal position wherein said bypass ports are not open, said piston movable between said first and second rotational positions by sequential longitudinal movement.

6. The apparatus of claim 5, wherein said major sleeve comprises fluid exit ports therein.

7. The apparatus of claim 6, wherein said major sleeve comprises one or more perforations therein.

* * * * *